US007891586B2

(12) United States Patent
Ganser et al.

(10) Patent No.: US 7,891,586 B2
(45) Date of Patent: Feb. 22, 2011

(54) FUEL INJECTION VALVE FOR INTERNAL COMBUSTION ENGINES

(75) Inventors: Marco Ganser, Oberägeri (CH); Ulrich Moser, Rickenbach-Attikon (CH)

(73) Assignee: Ganser-Hydromag AG (CH)

( * ) Notice: Subject to any disclaimer, the term of this patent is extended or adjusted under 35 U.S.C. 154(b) by 93 days.

(21) Appl. No.: 12/445,730

(22) PCT Filed: Oct. 15, 2007

(86) PCT No.: PCT/CH2007/000506

§ 371 (c)(1),
(2), (4) Date: Apr. 15, 2009

(87) PCT Pub. No.: WO2008/046238

PCT Pub. Date: Apr. 24, 2008

(65) Prior Publication Data

US 2010/0294243 A1 Nov. 25, 2010

(30) Foreign Application Priority Data

Oct. 16, 2006 (CH) ..... 1647/06

(51) Int. Cl.
*F02M 51/00* (2006.01)

(52) U.S. Cl. ..... 239/585.5; 239/533.2; 239/533.4; 123/456

(58) Field of Classification Search ..... 239/88, 239/533.2, 533.4, 585.5; 123/456
See application file for complete search history.

(56) References Cited

U.S. PATENT DOCUMENTS 4,826,080 A 5/1989 Ganser (Continued)

FOREIGN PATENT DOCUMENTS

DE 31 19 050 11/1982

(Continued)

OTHER PUBLICATIONS

International Search Report mailed May 16, 2008 in PCT/CH2007/000506 (English language).

(Continued)

*Primary Examiner*—Erick Solis
(74) *Attorney, Agent, or Firm*—Hershkovitz & Associates, LLC; Abraham Hershkovitz

(57) ABSTRACT

Disclosed is a fuel injection valve (4) comprising a control member (70) that is provided with a control passageway (114) which is arranged eccentrically relative to the housing axis (8) and can be opened and closed by a closure piece (96) with the aid of an actuator assembly (26) in order to obtain intermittent injections. The control member (70) is positioned by means of a centering pin (124) in order to define the circumferential position of the eccentric control passageway (114). The centering pin (124) is guided within a pocket bore of the control member (70) as well as within a bore of an intermediate plate (12), a cylindrical element (13), or a spacing sleeve (202). The actuator assembly (26) is designed as an electromagnetic actuator (80) in which the stop (98; 99) for limiting the lift of the pilot valve member is designed as a monolithic component of the intermediate plate (12) or as a flat stop disk (97) in a separate workpiece. The eccentric position of the actuator assembly (26) and the design of the stop (98; 99) allow for a very compact design of the fuel injection valve. The compact design makes it possible to mount a suitable storage chamber in the monolithic housing body (10) of the fuel injection valve, above the high-pressure inlet bore (20).

18 Claims, 8 Drawing Sheets

U.S. PATENT DOCUMENTS

Figure 1:
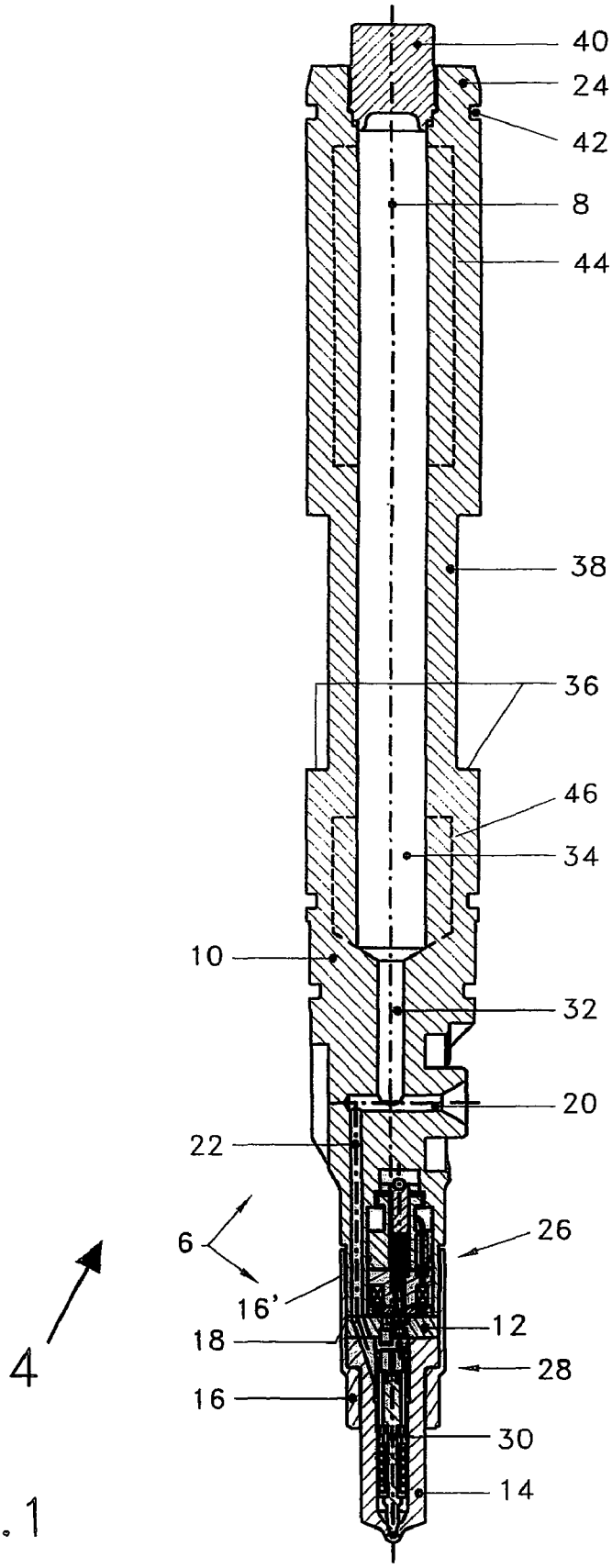

| | | | | |
|---|---|---|---|---|
| 5,873,526 | A * | 2/1999 | Cooke | 239/88 |
| 6,405,941 | B2 * | 6/2002 | Ganser | 239/88 |
| 6,726,128 | B2 * | 4/2004 | Schempp | 239/533.2 |
| 7,591,436 | B2 * | 9/2009 | Ganser | 239/96 |
| 2003/0132410 | A1 * | 7/2003 | Stoecklein et al. | 251/57 |
| 2008/0093484 | A1 | 4/2008 | Stoecklein et al. | |
| 2008/0296413 | A1 | 12/2008 | Ganser | |

FOREIGN PATENT DOCUMENTS

| | | |
|---|---|---|
| DE | 10031 698 | 1/2002 |
| DE | 101 39 623 A1 | 2/2003 |
| DE | 10 2005 026514 | 8/2006 |
| DE | 10 2005 035347 | 8/2006 |
| EP | 0 426 205 | 5/1991 |
| WO | WO 2005/008059 | 1/2005 |
| WO | WO 2005/080785 | 9/2005 |
| WO | WO 2007/009279 | 1/2007 |

OTHER PUBLICATIONS

English language Abstract for DE 10 2006 035347.
PCT Written Opinion of the International Search Authority issued in PCT/CH2007/000506 (English language).
Abstract of DE 101 39623.

* cited by examiner

FUEL INJECTION VALVE FOR INTERNAL COMBUSTION ENGINES

The present invention relates to a fuel injection valve for the intermittent injection of fuel into the combustion chamber of an internal combustion engine according to the preamble of claim 1, which is preferably used in diesel engines.

Fuel injection valves of this type are disclosed, for example, by DE 31 19 050, by the published patent application DE 10031 698 and by the international patent application WO 2005/080785 A1.

In DE 31 19 050 an injection valve is shown having a fuel accumulator chamber integrated in the housing.

Both the fuel injection valves in DE 31 19 050 and those in DE 10031 698 and WO 2005/080785 A1 are of elaborate construction, which has an adverse impact on the manufacturing costs. The fuel injection valves in DE 31 19 050 and the published patent application DE 10031 698 have multiple, long, narrow bores, which are subjected to fuel at high pressure. In the international patent application WO 2005/080785 A1 the injection valve member is especially long. These design features mean additional manufacturing costs. The accumulator chamber in DE 31 19 050 is furthermore sited in the upper area of the fuel injection valve, which has an adverse effect on the overall design length and the external dimensions of the housing in the area of the accumulator chamber of the fuel injection valve.

The object of the present invention is to create a fuel injection valve of especially simple construction.

This object is achieved by a fuel injection valve as claimed in claim 1.

All working elements of the fuel injection valve are sited in close proximity to the nozzle body or fitted in the nozzle body, so that, even if the high-pressure fuel feed connection has to be situated close to the nozzle body, there is space for the working elements below the fuel feed connection. This firstly affords a high degree of freedom when it comes to attaching the high-pressure fuel feed connection of the fuel injection valve, the position of which differs according to the type of internal combustion engine. Secondly the narrow high-pressure bores of the fuel injection valve are short and easy to manufacture. Thirdly the injection valve member is very simple and compact.

These advantages are obtained thanks to an actuator assembly, which is arranged eccentrically in relation to the housing axis and which is capable of opening and closing a control passage, correspondingly arranged eccentrically in a control member and preferably with a restrictor on the outlet side.

The high-pressure feed bore situated above the actuator assembly is preferably connected to a longitudinal bore, which runs at the side of the actuator assembly and hydraulically connects the high-pressure feed bore to a high-pressure chamber in the nozzle body. A further high-pressure bore preferably connects the high-pressure feed bore and consequently, via the longitudinal bore, also the high-pressure chamber in the nozzle body to an accumulator chamber of the fuel injection valve. The accumulator chamber of the fuel injection valve is slender and in a fuel injection valve having a slender housing can be accommodated very close to the fuel feed connection. The accumulator chamber is a single bore of large cross-section.

As in the international patent application WO 2005/080785 A1, the control member at its circumference is radially guided with some play and without forming a seal, that is to say loosely guided, by the wall of the high-pressure chamber of the nozzle body. Since the control passage in the control member is arranged eccentrically and must align with the actuator axis, arranged eccentrically in relation to the housing axis, according to the invention means are provided in order to align the eccentric circumferential position of the loosely fitted control member with control passage, preferably with the restrictor, on the actuator axis.

The actuator assembly is preferably fitted into an actuator seating recess in the housing body from an end face of the housing body, and a stop face for limiting the lift of an operating stem of the actuator assembly is according to the invention integrated into a stop plate, which at the same time serves as intermediate plate between the end face of the housing body and an upper end face of the nozzle body.

Figure 2:
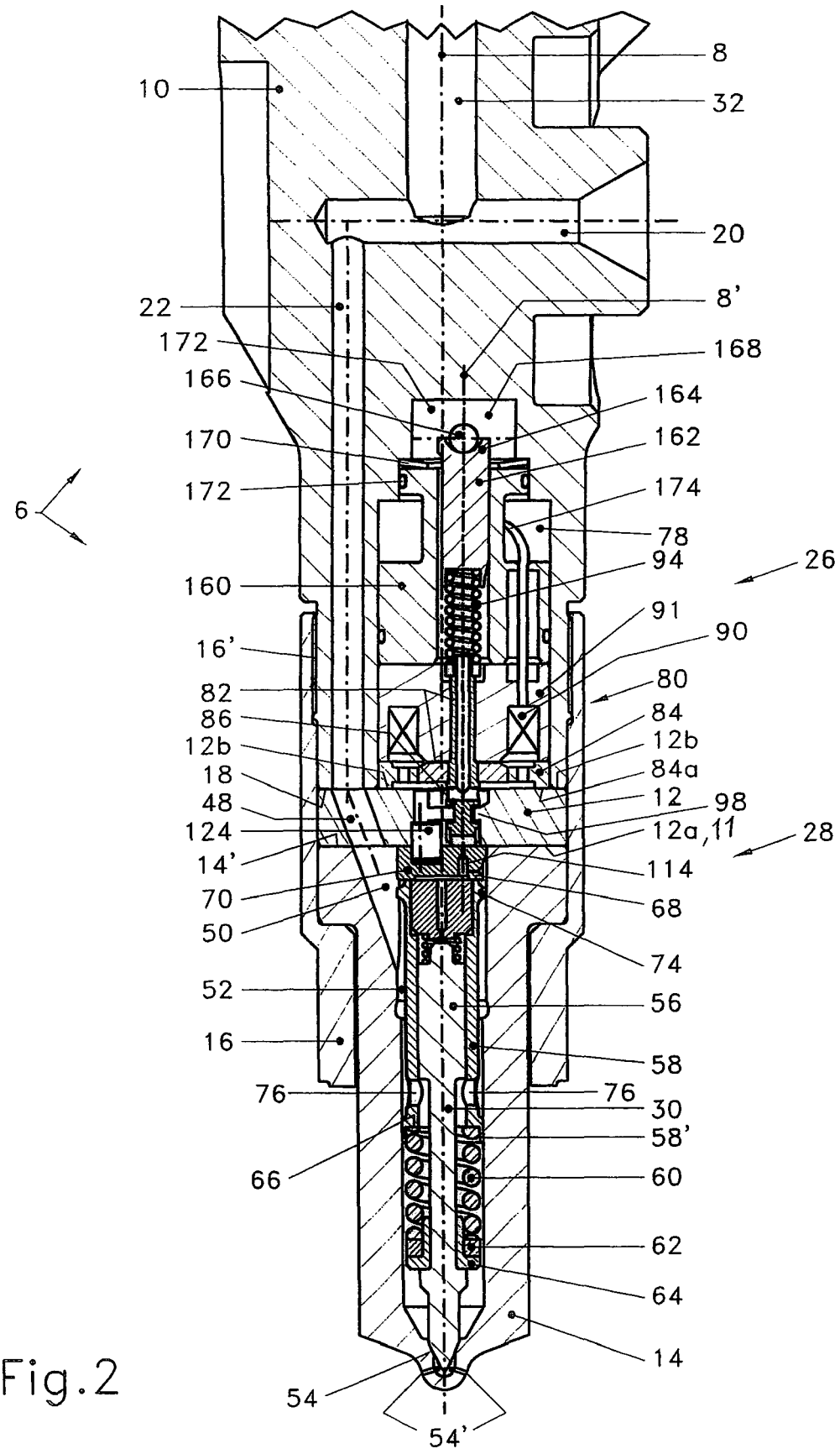
Figure 3:
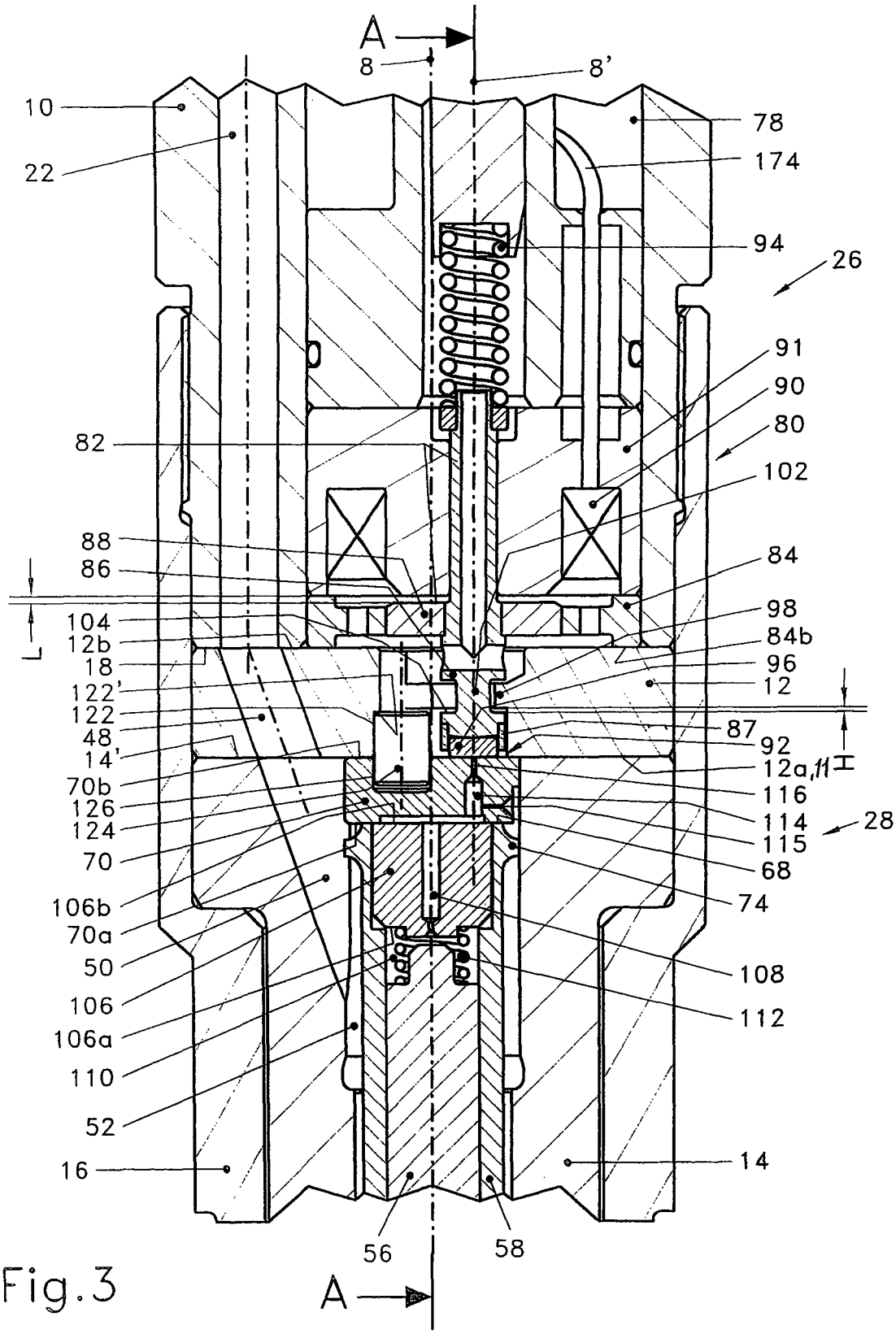
Figure 4:
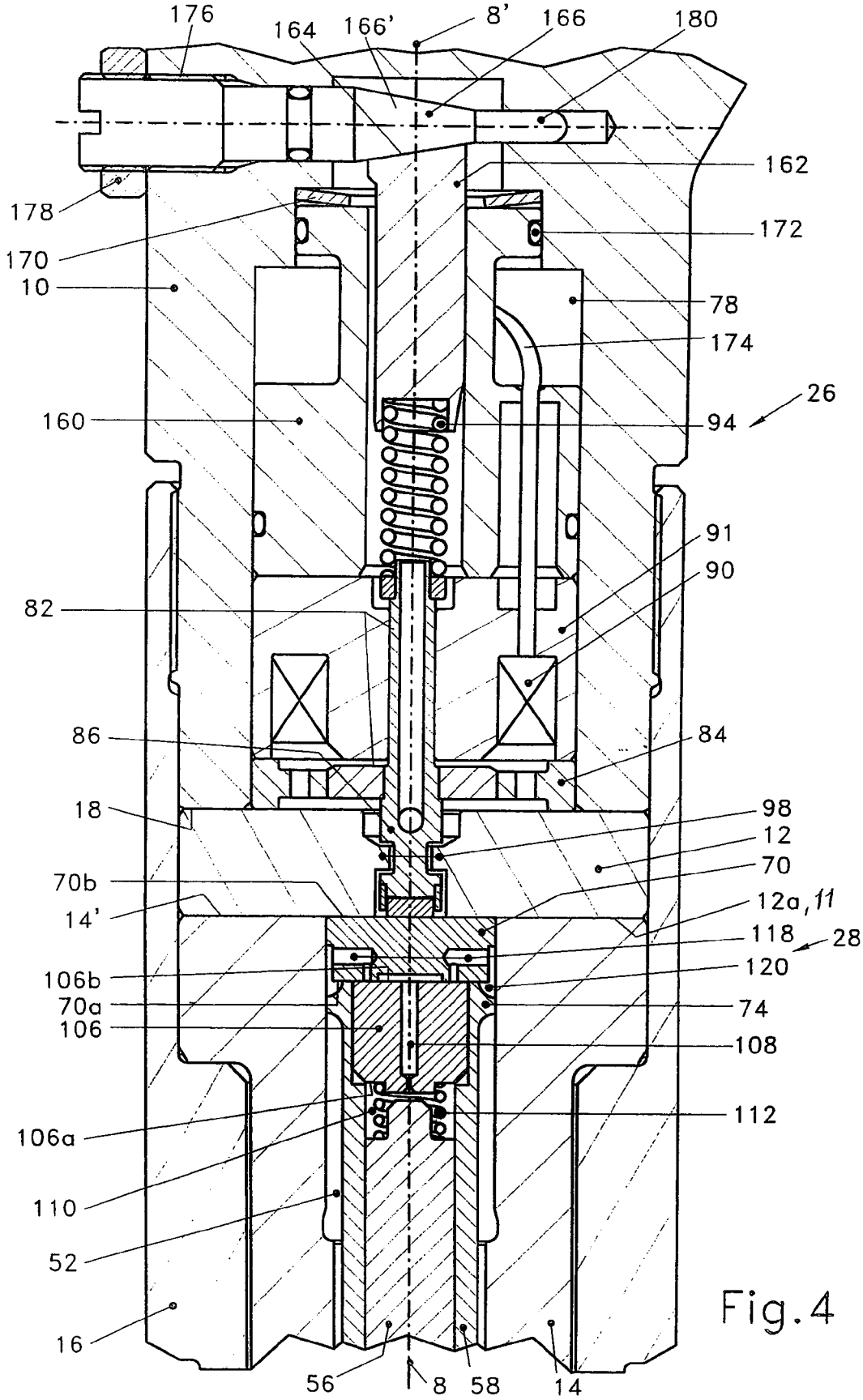
Figure 5:
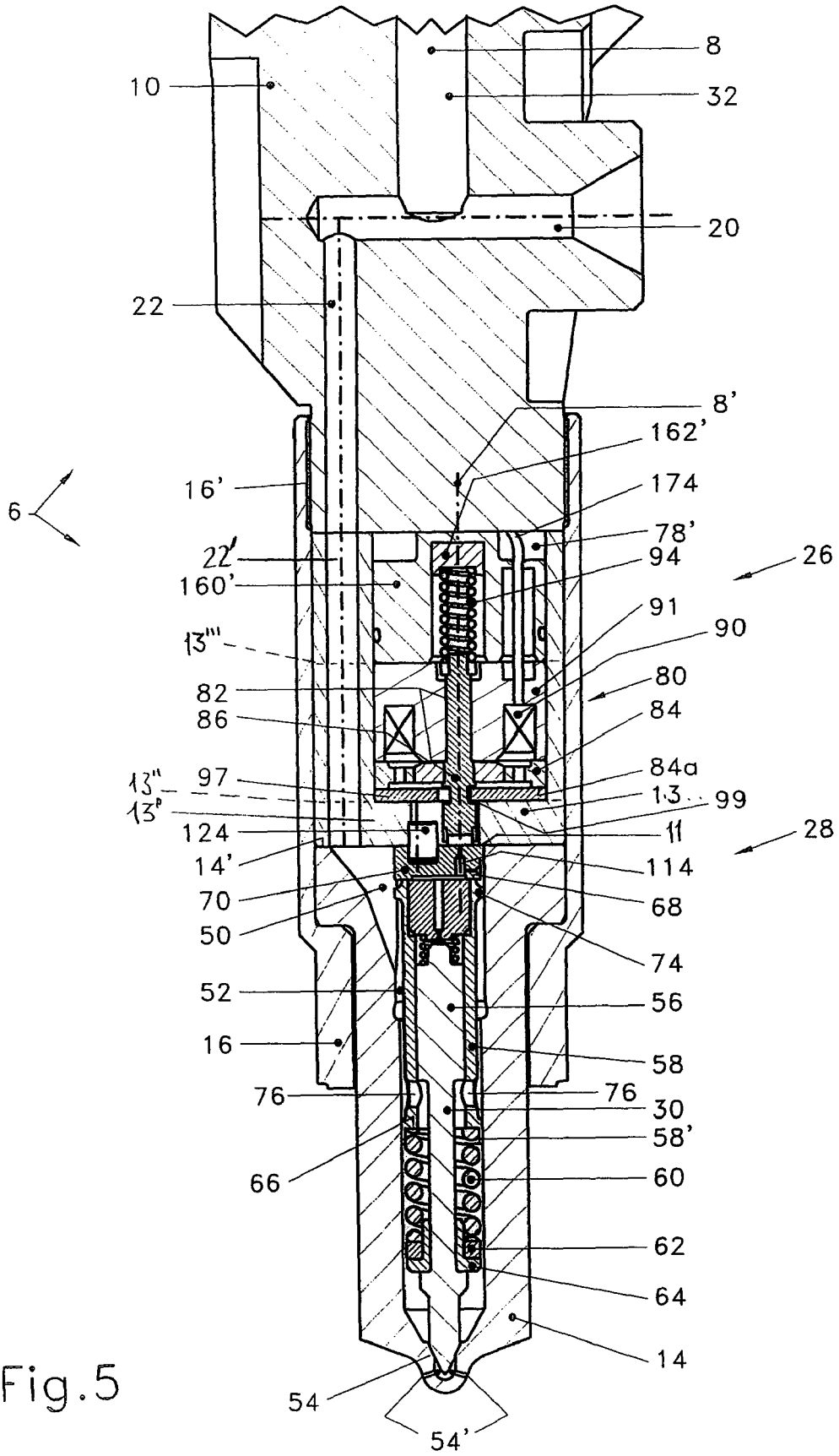
Figure 6:
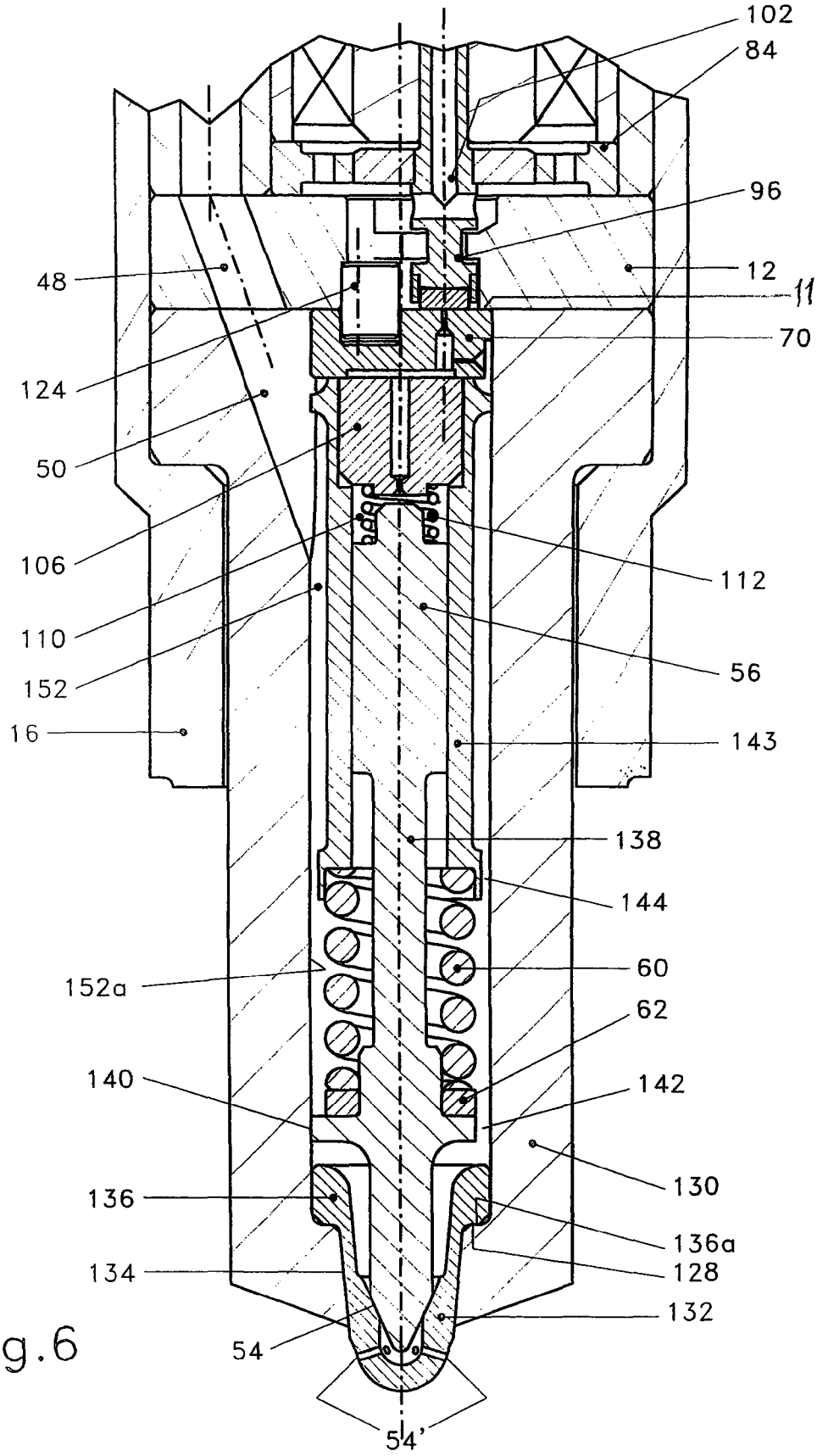
Figure 7:
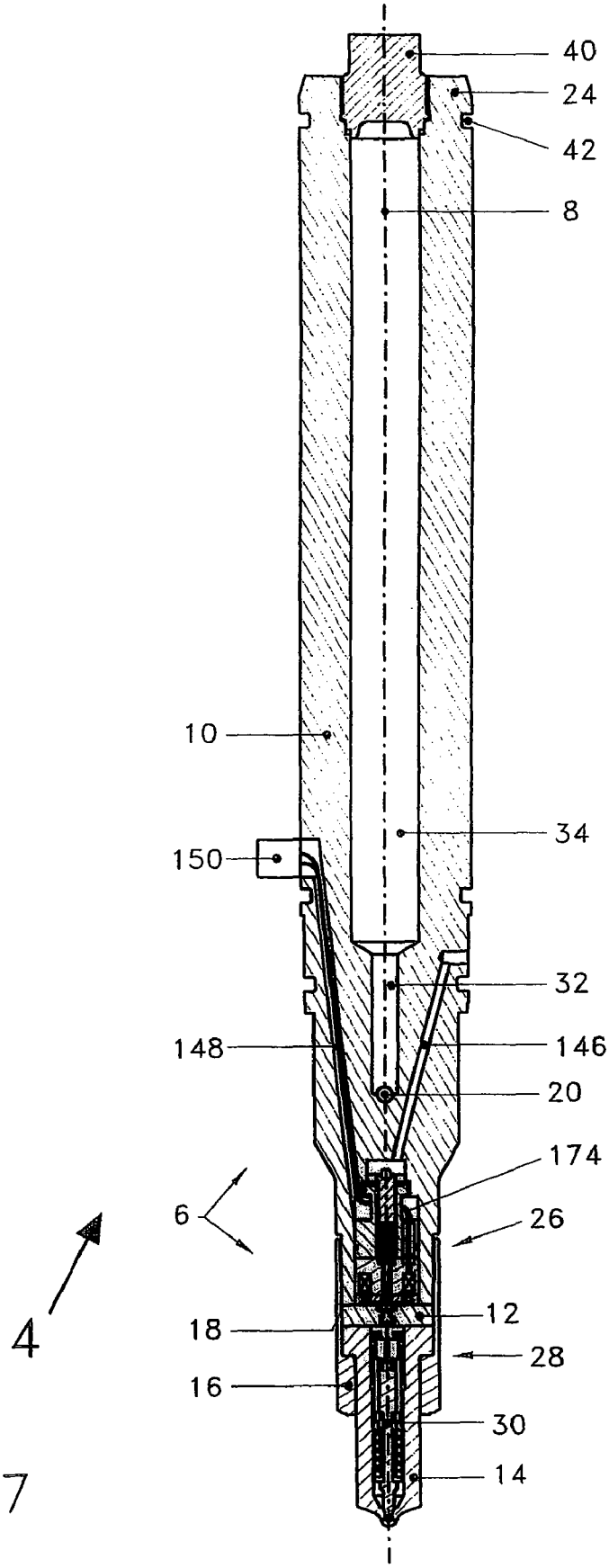
Figure 8:
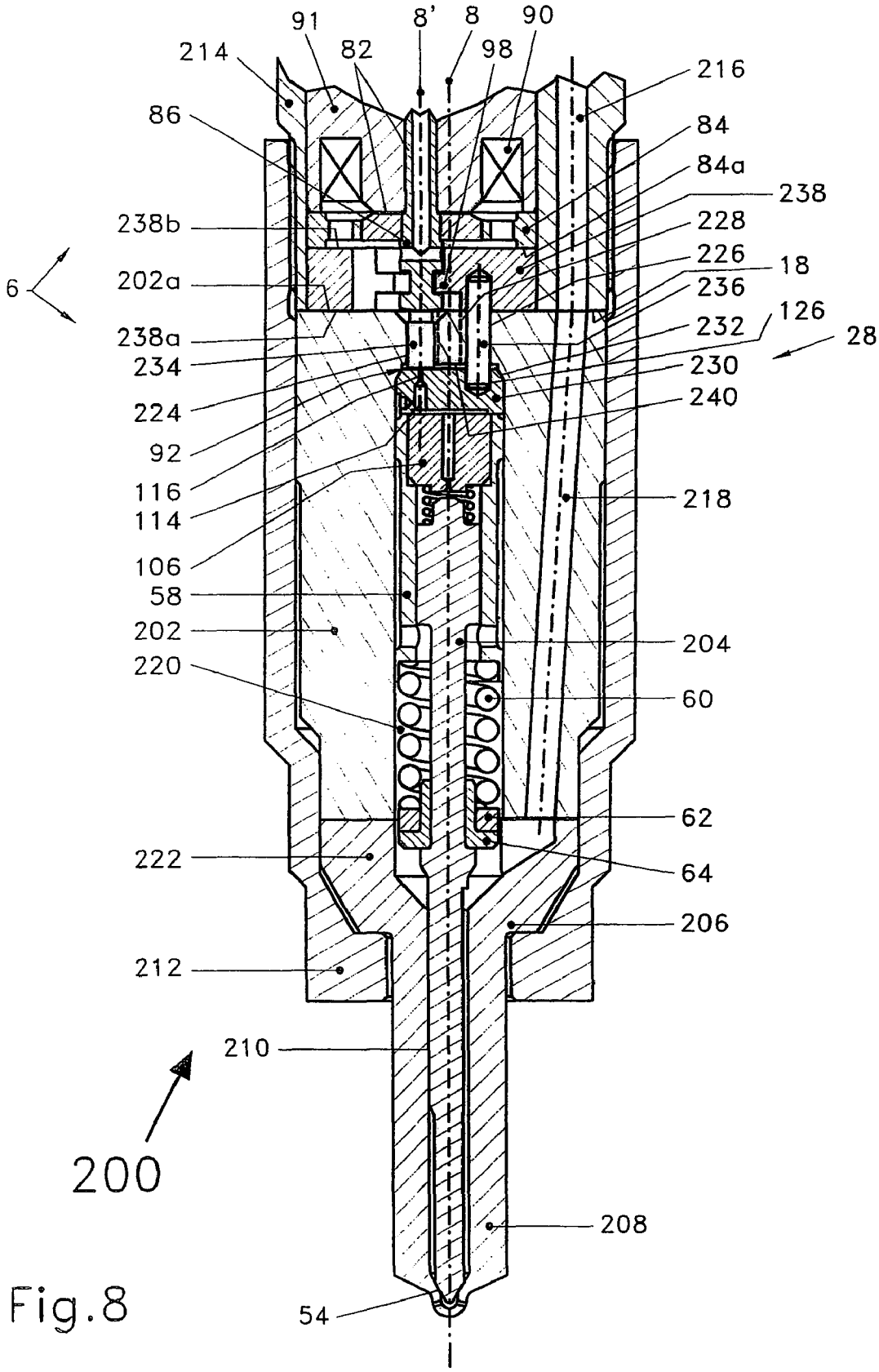

These and other advantages of the present invention will be explained in more detail with reference to preferred embodiments, which are represented in the drawings and described below. In the purely schematic drawings:

FIG. 1. shows a longitudinal section through a fuel injection valve, in which all working elements of the fuel injection valve are situated below the high-pressure fuel feed connection, and which has an accumulator chamber as a relatively long bore of large cross section above the fuel feed connection;

FIG. 2. in an enlarged representation shows a partial longitudinal section through the fuel injection valve according to the invention in FIG. 1 with its working elements, including the eccentric arrangement of the actuator and the control member positioned by means of a centering pin;

FIG. 3. shows a partial sectional representation, yet further enlarged in comparison to FIG. 2, with the eccentric arrangement of the actuator and the stop for limiting the lift of the operating stem of the actuator assembly, which is integrated in the intermediate plate between the end face of the housing body and an upper end face of the nozzle body;

FIG. 4. shows a partial sectional representation according to section A:A in FIG. 3, which is perpendicular to the plane of section in FIG. 3 and which up to the end face of the nozzle body runs through the housing axis, and above this end face runs through the actuator axis;

FIG. 5. shows a partial section through a first alternative variant of the, fuel injection valve according to the invention, in which a cylindrical element, which is not integrally formed with the housing body, accommodates the actuator assembly;

FIG. 6. shows a partial section through a second alternative variant of the fuel injection valve according to then invention, in which the injection valve member comprises a guide together with a nozzle body holder and the nozzle body is fitted in the nozzle body holder as a separate component;

FIG. 7. shows a longitudinal section through the fuel injection valve according to the invention in FIG. 1 in a plane of section, which as in FIG. 4 is perpendicular to the plane of section in FIG. 1, and FIG. 8. shows a partial longitudinal section through a third alternative variant of the fuel injection valve according to the invention, having a spacing sleeve, into which a part of the injection valve member and the working elements of the hydraulic control device are fitted.

FIG. 1 shows a fuel injection valve 4, which is intended for the intermittent injection of fuel into the combustion chamber of an internal combustion engine. It comprises an elongate, externally partially cylindrical and stepped housing 6, the central housing axis of which is denoted by 8. The housing 6 comprises a one-piece housing body 10, an intermediate plate 12 and a nozzle body 14. The intermediate plate 12 and the nozzle body 14 are tightly held together and pressed against an axial end face 18 of the housing body 10 by a clamping nut 16 in the form of a union nut, which is threaded onto the housing body 10 by means of a thread 16'.

A high-pressure fuel inlet of the fuel injection valve 4 embodied as a high-pressure feed bore 20 is connected in a known manner to a fuel feed, which delivers fuel to the fuel injection valve 4 under very high pressure, of 1800 bar or more for example. The high-pressure feed bore 20 is situated substantially closer to the nozzle body 14 than to the upper end 24 of the housing body 10 and is made in the housing body 10 transversely to the housing axis 8 at an angle of 90°. One end of a longitudinal bore 22, which is likewise made in the housing body 10 and the other end of which opens into the end face 18, opens into the high-pressure feed bore 20.

At the side of longitudinal bore 22 and eccentrically arranged in relation to the housing axis 8 is an actuator assembly 26. A hydraulic control device 28 for a needle-shaped injection valve member 30 is situated in the nozzle body 14.

A high-pressure bore 32 in the housing body 10, made on the housing axis 8, opens on the one hand into the high-pressure feed bore 20 and on the other into an accumulator chamber 34 of the housing body 10, which is embodied as a narrow bore and in which high-pressure fuel is stored. The fuel injection valve 4 is secured in the cylinder head of the internal combustion engine by means of a clamp (not shown), which in a known manner transmits its clamping force to two shoulders 36 of the housing body 10, and is held against the combustion chamber (not shown), forming a seal. In an area 38 above the shoulders 36, the outer wall of the housing body 10 is tapered over a specific length and may thereafter become thicker again. The accumulator chamber 34 is relatively long and owing to the taper in the area 38 above the shoulders 36 the inside diameter of the accumulator chamber 34 may not be very great for reasons of strength. In order to obtain a volume sufficient for a specific fuel injection quantity, it is therefore advantageous if the accumulator chamber can extend as far forwards as possible, towards the high-pressure feed bore 20. At the upper end 24 the accumulator chamber 34 is tightly closed by means of a plug 40 threaded into the housing body 10. A cylinder head cover (not shown) encloses the housing body 10 in the area of an O-ring groove 42. The entire fuel injection valve 4 with accumulator chamber 34 is therefore situated below the cylinder head cover of the internal combustion engine and only the plug 40 and the upper end 24 are externally visible. Yet it is possible, due to the very compact arrangement of the working elements of the fuel injection valve 4, to accommodate an accumulator chamber 34, which is sufficiently large for most applications and which can be very easily produced as a narrow bore, in the one-piece housing body 10. The dashed lines 44 and 46 above and below the tapered area 38 serve to indicate how, if necessary, the volume of the accumulator chamber 34 can be enlarged without the need to modify the external contour of the housing body 10.

In other applications the fuel injection valve 4 does not have a tapered area 38 and is fixed in the cylinder head of the internal combustion engine by means other than a clamp. In these applications the shoulders 36 are dispensed with. An accumulator chamber 34 embodied as a narrow bore is nevertheless advantageous, since many fuel injection valves 4 have a slender external contour of the housing body 10.

In the description of the embodiments shown in FIGS. 2 to 8, the same reference numerals are used for the corresponding parts as are used in connection with the description of the fuel injection valve 4 shown in FIG. 1. Furthermore, it is proposed in the following description to explain only the differences compared to the fuel injection valve 4 shown in FIG. 1 and exemplary embodiments already previously described.

The partial section in FIG. 2, enlarged in comparison to FIG. 1, shows the working elements of the fuel injection valve 4 in more detail. In the intermediate plate 12 is a slanting bore 48, which connects the longitudinal bore 22 to a passage 50 in the nozzle body 14, which in turn from the upper end face 14' of the nozzle body 14 opens out into the high-pressure chamber 52 in the nozzle body 14. Situated in the high-pressure chamber 52, concentrically with the housing axis 8, is the needle-shaped injection valve member 30, which on the one hand interacts with the injection valve seat 54 and on the other is displaceably guided in the direction of the housing axis 8 in a tight sliding fit of approximately 0.002-0.010 mm inside a cylindrical guide sleeve 58 by a piston-like end area formed as control piston 56 and in the manner of a double-acting piston.

A closing spring 60 arranged concentrically around the injection valve member 30 is supported at one end via a support plate 62 and a supporting sleeve 64 in a known manner on a circumferential shoulder of the injection valve member 30 and exerts a closing force on said element, directed towards the injection valve seat 54. At the other end the closing spring 60 is supported on a first end face 66 of the guide sleeve 58, which with its opposite, second end face 68 bears against a control member 70. The pellet-shaped control member 70 is held in sealing contact against the lower end face 12*a* of the intermediate plate 12 by the force of the closing spring 60 and the fuel pressure. For this purpose the lower end face 12*a* forms a tight sealing face 11 against the housing. At its circumference the control member 70 is guided by the wall of the high-pressure chamber 52 with a play of a few hundredths of a millimeter, so that it does not form a radial seal, and is otherwise loosely arranged in the high-pressure chamber 52.

Adjacent to the control member 70 the guide sleeve 58 has a radially protruding centering ring 74, by means of which it is kept centered, without forming a radial seal, likewise against the circumference of the wall of the high-pressure chamber 52. For centering it in relation to the nozzle body 14, the guide sleeve 58 furthermore has a guide ring 58', protruding beyond the first end face 66 and enclosing the proximal end area of the closing spring 60 so as to center it. Since the centering ring 74 and the guide ring 58' are widely separated from one another in an axial direction and the piston-like end area 56 is designed with a sufficient length for guiding it against the guide sleeve 58 in the direction of the housing axis 8, it is possible to dispense with direct guidance of the injection valve member 30 on the nozzle body 14.

With the exception of the centering ring 74 and the guide ring 58', an annular gap exists between the guide sleeve 58 and the nozzle body 14. In proximity to the first end face 66, the guide sleeve 58 has radial passages 76, in order to connect the said gap hydraulically to the part of the high-pressure chamber 52 situated between the guide sleeve 58 and the injection valve seat 54. This affords large flow cross sections for feeding fuel from the passage 50 through the gap between the guide sleeve 58 and the nozzle body 14, through the radial passages 76, the closing spring 60 and the gap between the support plate 62 and the supporting sleeve 64 and the nozzle body 14 to the injection valve seat 54.

Eccentrically offset in relation to the housing axis 8 and opposite the longitudinal bore 22, the housing body 10 has a blind hole-like actuator seating recess 78, which proceeds from the end face 18 and in which a known electromagnetic actuator 80 (it could also be a piezoelectric actuator) is arranged for controlling the fuel injection valve 4. The actuator 80 and the working elements associated with the actuator 80 are arranged on the actuator axis 8', which is eccentrically offset in relation to the housing axis 8. A known magnetic closing ring 84 is situated in the actuator seating recess 78 adjacent to the end face 18. In a likewise known alternative electromagnetic actuator 80 without a magnetic closing ring 84, a spacing ring is used in its place. A lower, plane face 84*a* of the magnetic closing ring 84 (or the spacing ring) is supported directly on the upper face 12*b* of the intermediate plate 12.

In the area above a magnetic body 91 of the actuator 80 is a hollow cylindrical magnetic head part 160, in which an actuator spring 94 is arranged. The actuator spring 94 is held pre-tensioned by a pin-like pre-tensioning part 162 guided in the upper area of the magnetic head part 160. A pre-tensioning screw 166 (see also in FIG. 4 and the associated part of the description) projects in a transverse direction into the upper concave end 164 of the pre-tensioning part 162, which is situated in a blind hole 168 in the housing body 10. Return fuel, which is discharged by the hydraulic control device 28 during each injection sequence, flows from the actuator 80 in passages and bores (not further denoted) into the blind hole 168 and is then removed by the fuel injection valve 4 (see also FIG. 7). An O-ring 172 seals off the space in the blind hole 168 from the actuator seating recess 78. A strand 174 is led from the winding 90 laterally though the magnetic head part 160 and thence to a connector (see also FIG. 7). A disk spring 170, which is situated between the actuator seating recess 78 and the blind hole 168, is supported on the one hand on the housing body 10. The disk spring 170 is internally supported on the magnetic head part 160. The actuator assembly 26 is therefore pressed against the upper face 12*b* of the intermediate plate 12 and is stably held under pre-tension.

FIGS. 3 and 4 show the details of the actuator assembly 26 and the hydraulic control device 28 on a yet larger scale than FIG. 2. The plane of section of FIG. 3 is the same as that in FIG. 2. The planes of section in FIG. 4 are perpendicular to the plane of section in FIG. 3 and up to the end face 14' of the nozzle body 14 run through the housing axis 8, above this end face 14' through the actuator axis 8' (cf. line of section A-A in FIG. 3).

The actuator 80 has an operating stem 86, which interacts with a pilot valve member 82 and a pellet-shaped closing part 96 for a pilot valve 92 and which is fixed to a plate-like armature 88. Electrical excitation of the winding 90 of the magnetic body 91 causes the armature 88 and hence the operating stem 86 to be attracted in opposition to the force of the actuator spring 94, acting in the direction of the closing position of the pilot valve 92, which leads to opening of the pilot valve 92. The opening travel H of the operating stem 86 is smaller than the air gap L between the armature 88 and the magnetic body 91, since the operating stem 86 first has a tapered area 102 in the lower part, which on the side of the closing part 96 widens out again below a stop 98, integrally formed on the intermediate plate 12, and forms an annular face 104 acting as counter-stop. By striking against the lower face of the projecting stop 98 of the intermediate plate 12, the annular face 104 limits the lift H of the pilot valve member 82, in order that a residual air gap between the armature 88 and the magnetic body 91, which is equal to L minus H, positively influences the shut-off behavior of the electromagnetic actuator 80 in a known manner. The geometric shape of the projecting stop 98 and the fitting of the pilot valve member 82 are of the same design concept as in the corresponding stop in the international patent application WO 2005/080785 A1, which is there referred to as a stop shoulder and is described in detail in FIGS. 3 and 4 of this application.

On excitation of the winding 90, the pilot valve 92 is closed by means of the actuator spring 94.

The closing part 96 is radially guided with some play by an annular part 87, which as a separate part is firmly connected to the operating stem 86, which can be achieved, for example, by welding the two pieces or by a press fit. Alternatively the annular part 87 may be integrally produced in one piece with the operating stem 86 in a known manner.

Elements of the hydraulic control device 28 additional to the embodiment in FIG. 2 will be described with reference to FIGS. 3 and 4.

Situated in the guide sleeve 58 is an intermediate valve body 106, which is displaceable in the direction of the housing axis 8 and guided with play in the guide sleeve 58, and which has a lower end face 106*a*. A restriction passage 108, which is coaxial with the housing axis 8 and which extends between the lower and upper end faces 106*a*, 106*b* of the intermediate valve body 106, runs in the intermediate valve body 106.

A spring element 112, which rests on the intermediate valve body 106 on the one hand and on a support end face of the control piston 56 on the other, is arranged in a control chamber 110 for the injection valve member 30. The spring element 112 encloses a central projection of the control piston 56 and generates a force acting on the intermediate valve body 106, which is substantially smaller than the force exerted by the closing spring 60. With the upper end face 106*b* the intermediate valve body 106 bears on a lower end face 70*a* of the control member 70 serving as sealing face.

The control member 70 has a control passage 114, which is eccentrically offset in relation to the housing axis 8 and coaxial with the actuator axis 8', and into which a restrictor 115 opens, which is hydraulically connected to the high-pressure chamber 52. At its end opening into the upper end face 70*b* of the control member 70, the control passage 114 has a restrictor 116. The control passage 114 is hydraulically connected to the restriction passage 108 in the intermediate valve body 106.

Further passages 118, which open into the lower end face 70 of the control member 70, are formed in the control member 70 (See FIG. 4). At the other end, the passages 118 are connected to a chamber 120, which like the restrictor 115 has an unimpeded connection to the high-pressure chamber 52 and in which the high fuel pressure therefore prevails. With the fuel injection valve 4 in the closed position, that is to say between the injection sequences, the passages 118 through the intermediate valve member 106 are closed and it is pressed by the spring element 112 with its upper end face 106*b* against the lower end face 70*a* of the control member 70.

The operating principle of the fuel injection valve 4 may be summarized as follows: when the actuator assembly 26 is energized, the hydraulic control device 28 responds. This produces a movement of the injection valve member 30 away from the injection valve seat 54, so that fuel under high pressure flows from the accumulator chamber 34 via the bore 32 and from the high-pressure feed bore 20 through the longitudinal bore 22 to the nozzle injection openings 54' and the injection sequence commences. When the actuator assembly 26 is de-energized, the hydraulic control device 28 causes the injection valve member 30 to move in the direction of the injection valve seat 54, until the injection sequence is interrupted. For a precise description of the operating principle, reference is made to the state of the art, which in the international patent application WO 2005/080785 A1, for example, describes a fuel injection valve of the same type in detail.

Returning to FIG. 3, the intermediate plate 12 has a bore 122 with a flange 122', in which a centering pin 124 is positioned, which projects further into a blind hole 126 of the control member 70, introduced from the upper end face 70*b*, and aligns this control member 70. A means of aligning the circumferential position of the control member 70 relative to the actuator assembly 26 is needed owing to the eccentric arrangement of the control passage 114 and the restrictor 116, both of which together with actuator assembly 26 have to be aligned substantially on the actuator axis 8'. The flange 122' fixes the axial position of the centering pin 124 in an upward direction with some play. The housing body 10, the intermediate plate 12 and the nozzle body 14 are likewise positioned relative to one another in a known manner (not shown), in order to ensure the alignment of the longitudinal bore 22, the slanting bore 48 and the passage 50.

In a design variant not shown the means of aligning the control member 70 are situated at its circumference and engage in the upper end of the wall of the high-pressure chamber 52 of the nozzle body 14. These means may be represented, for example, by an asymmetrical design shape of the control member 70 in this area, with corresponding adaptation to the shape of the wall of the nozzle body 14, for example through a convexity at a suitable point on the control member 70 with a corresponding concavity of the wall of the nozzle body 14. Instead of the design shape, it is also possible to use an additional part, radially introduced at the circumference of the high-pressure chamber 52, similar to the centering pin 124.

Owing to the alignment of the control member 70, the eccentric arrangement of the control passage 114, the stop 98, integrally produced on the intermediate plate 12 for limiting the lift H of the pilot valve member, and the radial guiding of the pellet-shaped closing part 96 with the annular part 87 of the operating stem 86, and owing to the fact that the actuator assembly 26 can be fitted into the actuator seating recess 78 from the end face 18 of the housing body 10, a very compact construction results in the longitudinal direction of the fuel injection valve 4.

If a piezoelectric actuator, which is known to be radially narrower than an electromagnetic actuator, is used instead of an electromagnetic actuator 80, it is also possible, by virtue of the advantages cited above, to make the outside diameter very small and compact in the area of the clamping nut 16. Furthermore, with a piezoelectric actuator the projecting stop 98 on the intermediate plate 12, serving as stop shoulder, can be dispensed with. This alternative construction can therefore be successfully used both for large diesel engines, as in ships, locomotives and construction machinery, and also in smaller engines in the truck size range and smaller.

FIG. 4 also shows how the actuator spring 94 can be pre-tensioned with the pre-tensioning part 162 and the pre-tensioning screw 166. A conical piece 166' of the pre-tensioning screw 166 engages in the upper concave end 164 of the pre-tensioning part 162, which has an oblique contact face. By turning the pre-tensioning screw 166 clockwise or counter-clockwise in the housing body 10 by means of the thread 176, the conical piece 166' is capable of displacing the pre-tensioning part 162 downwards to a greater or lesser extent, in order to adjust the pre-tensioning force of the actuator spring 94. Once the desired value is set, the pre-tensioning screw 166 can be locked with a lock nut 178. By means of a lug 180 on the pre-tensioning screw 166, this can be additionally guided and supported in the housing body 10. This external adjusting measure is very practical.

Alternatively it is possible, in a known manner, to use a fixed adjustment or an adjusting device of the actuator spring, which can no longer be adjusted once the injection valve has been assembled (see also FIG. 5 with regard to this).

FIG. 5 shows a partial section through a first alternative variant of the fuel injection valve according to the invention. A cylindrical element 13 forms a separate piece, which is not integrally formed with the housing body 10. This cylindrical element 13 comprises a base part 13', which corresponds to the intermediate plate 12 disclosed in FIGS. 1 to 4, and a piece situated above this, in which the actuator seating recess 78' with the actuator assembly 26 is eccentrically accommodated. To the side of the actuator seating recess 78', the bore 22' is situated in the cylindrical element 13, where it serves as an extension of the bore 22. The clamping nut 16 is of correspondingly longer design and the thread 16' is situated further upwards than shown in FIG. 2. This variant with a cylindrical element 13, which comprises the actuator seating recess 78', the bore 22' and the base part 13, facilitates assembly of the actuator assembly 26. If necessary, the base part 13' may also be embodied as a separate part, which is represented in FIG. 5 by a dashed line 13". The cylindrical element 13 is firmly clamped to the housing between the housing body 10 and the nozzle body 14 by means of the clamping nut 16.

The magnetic head part 160', which is situated above the magnetic body 91, contains a pre-tensioning part 162' of given thickness for pre-tensioning of the actuator spring 94. In this embodiment the pre-tensioning force of the actuator spring 94 can no longer be externally adjusted once the fuel injection valve is assembled.

FIG. 5 furthermore shows an alternative design of the stop for the pilot valve member 82, which is embodied as a plane stop plate 97 and is arranged between the magnetic closing ring 84 and the base 78" of the actuator seating recess 78'. Here, in a manner similar to the intermediate plate 12 (FIGS. 1 to 4), the base part 13' on its underside forms the tight sealing face 11 against the housing together with the upper end face **70*b* of the control member 70, which tightly separates the high-pressure chamber 52 from the actuator seating recess 78'. The operating stem 86 of the pilot valve member 82 can be laterally displaced by the stop disk 97, before these two components are fitted into the cylindrical element 13. Once fitted, their operating principle is analogous to that described in connection with FIGS. 2, 3 and 4. The lower plane face of the stop disk 97 serves as stop 99. This simple design of the stop as a plane stop disk 97 can naturally also be used as an alternative to the solution according to FIGS. 1 to 4. The intermediate plate 12 in this case no longer has a projecting stop 98**.

The dashed line 13'" indicates a further alternative embodiment. Here the cylindrical element 13 extends from the nozzle body 14 to the line 13'". The housing body 10 bears on the cylindrical element 13, and the clamping nut 16 is of correspondingly shorter design. The housing body 10 has a blind hole recess for the actuator spring 94; figuratively speaking, the magnetic head part 160' is formed on the housing body 10.

FIG. 6 shows a partial section through a second alternative variant of the fuel injection valve according to the invention.

The high-pressure chamber 152 of a hollow cylindrical nozzle body holder 130 extends with a sufficiently large inside diameter **152*a* up to a shoulder 128. The nozzle body 132, as described in WO 2005/008059 A1, is manufactured as a cupped component, separate from the nozzle body holder 130, from an especially wear-resistant material and with a tapered face 134, together with a matching tapered face of the nozzle body holder 130, seals off the high-pressure chamber 152 from the engine combustion chamber (not shown). In order to increase the component strength of the nozzle body 132, in the design construction in FIG. 6 the nozzle body 132 is designed with an integrally formed collar 136. The cylindrical circumference of the collar 136 has a play of a few hundredths of a millimeter with the inside diameter 152*a* and is supported by its face 136*a* on a shoulder 128 of the nozzle body holder 130**. This design construction has a better compressive strength than that disclosed in WO 2005/008059 A1.

The injection valve member 138 with a sufficient clearance above the collar 136 furthermore has a guide 140 together with the inside diameter 152*a*. This guide 140 may be small and has at least one passage 142, for example three passages 142, which are made around the circumference of the guide 140, each offset by 120°. The play between the guide 140 and the inside diameter 152*a* may be between 0.002 and 0.05 mm, that is substantially more than in conventional injection nozzles, since the guide 140 is situated close to the injection valve seat 54. The support plate 62 is supported directly on the upper side of the guide 140. At the bottom the guide sleeve 143 is no longer guided in the nozzle body holder 130, as in FIGS. 1 and 2, but forms an annular passage 144. The radial passages 76 in the guide sleeve (see FIG. 2) are also superfluous.

The passage cross sections of the passages 142 and 144 are such that in an injection sequence the fuel can flow from the passage 50 to the injection valve seat 54 without significant pressure loss.

In an alternative variant the injection valve member 138 is guided by an inner guide of a collar 136 of the nozzle body 132 extended for this purpose. The guide 140 of the injection valve member 138 with the nozzle body holder 130 is in this case dispensed with.

FIG. 7 is a longitudinal section through the fuel injection valve 4 according to the invention shown in FIG. 1, in a plane of section which as in FIG. 4 is perpendicular to the plane of section in FIG. 1. 146 denotes the bore for the return of fuel discharged during the injection sequence and 148 denotes a bore in the housing body 10, in which the strands 174 of the winding 90 are led to an electrical connection 150 for these strands 174 sited outside on the housing body 10.

FIG. 8 shows a partial longitudinal section through a further fuel injection valve 200 according to the invention, having a spacing sleeve 202, into which a part of the injection valve member 204 and the working elements of the hydraulic control device 28 are fitted. This design construction is advantageous when the front part 208 of the nozzle body 206 is so slender that there is only enough space in this for the guide 210 of the injection valve member 204.

A clamping nut 212 clamps the nozzle body 206 onto the spacing sleeve 202 and clamps the latter to the housing body 214, these elements having the known sealing faces for sealing off the high pressure. The high-pressure fuel passes through the longitudinal bore 216 in the housing body 214 and through a longitudinal bore 218 in the spacing sleeve 202 to the nozzle body 206. A high-pressure chamber 220, in which the support plate 62, the closing spring 60, the guide sleeve 58 and the hydraulic control device 28 together with an upper part of the injection valve member 204 are situated, is situated centrally in the spacing sleeve 202. More or fewer of the aforementioned elements are situated in the spacing sleeve 202, depending on how long the spacing sleeve 202 is, and accordingly how long also the upper part 222 of the nozzle body 206 is.

In the area of the upper end face 202*a* the spacing sleeve 202 is closed except for three bores 224, 226 and 228. The control member 230 is supported on a conical shoulder 232, which forms the tight sealing face 11 against the housing and therefore seals off the high-pressure chamber 220. Alternatively a plane shoulder, standing perpendicular to the housing axis 8 could also be used to support the control member 230 and to seal off the high-pressure chamber 220. As in the embodiment in FIGS. 1 to 7, the control member 230 is moreover also radially not tightly guided, but is loose in the high-pressure chamber 220 and axially positioned by the shoulder 232.

A circular cylindrical closing part 234 is guided in the bore 224. The centering pin 236 is guided in the bore 226. The bore 228, shown by dashed lines, is situated in a position behind the bores 224 and 228 and serves to drain off the fuel discharged during an injection from the outlet side of the pilot valve 92 into the stop plate 238 and thence away from the fuel injection valve 200 in a manner not shown in detail. In addition a hydraulic connection 240 is situated above the control member 230. Alternatively this hydraulic connection 240 could be formed by a suitable recess in the control member 230 and the control member 230 could then be supported by the remaining part of an upper, plane face against an inner, plane end face of the spacing sleeve 202 and could seal off the high-pressure chamber 220.

The centering pin 236 centers, in relation to the spacing sleeve 202, both the control member 230 and the stop plate 238, which with its face 238*a* directly adjoins the upper end face 202*a* and with its face 238*b* adjoins the lower face 84*a* of the magnetic closing ring 84. The front part of the operating stem 86 is situated inside the stop plate 238 and the stop for limiting the lift of the pilot valve member is of the same design as in the corresponding element in the international patent application WO 2005/080785 A1. Obviously these details can also alternatively be designed in the same way as in the fuel injection valve 4.

In a variant (not shown) of the fuel injection valve according to the present invention the high-pressure feed bore is arranged axially in the plug 40 together with the associated high-pressure connection. In a further variant (not shown), which is advantageous when the housing body 10 is very slender, the plug 40 is widened upwards to an accumulator chamber and is hydraulically connected to the longitudinal bore 22 or 216 by a bore in the area of the thread of the plug 40.

The features of the fuel injection valves 4 and 200 of the present invention can obviously also be employed individually or in combinations other than those shown here.

The invention claimed is:

1. A fuel injection valve (4; 200) for the intermittent injection of fuel into the combustion chamber of an internal combustion engine, having an elongate housing (6), which comprises a housing body (10; 214) and a nozzle body (14; 132; 206) with an injection valve seat (54), a high-pressure chamber (52; 152; 220), which is arranged in the housing and which is connected to a high-pressure fuel inlet (20) and to the injection valve seat (54), an injection valve member (30; 138; 204), which is arranged so that it is longitudinally adjustable in the housing (6) and which interacts with the injection valve seat (54), and a closing spring (60), which is supported on the one hand on the injection valve member (30; 138; 204) and exerts a closing force on that element, directed towards the injection valve seat (54), and which on the other hand is supported at least via a guide sleeve (58; 143) and a control member (70; 230) on a face (11) fixed to the housing and in so doing presses the control member (70; 230) against the face (11), sealing off the high pressure chamber (52; 152; 220), the control member (70; 230) having a control passage (114), which is arranged eccentrically offset in relation to a housing axis (8), defining a central longitudinal axis of the housing (6), and which for the purpose of controlling the opening and closing movement of the injection valve member (30; 138; 204) can be opened and closed by an actuator assembly (26), and means being provided for fixing the eccentric circumferential position of the control passage (114) of 'the control member (70; 230) on an actuator axis (8') shared with the actuator assembly (26) and eccentrically offset in relation to the housing axis (8).

2. The fuel injection valve as claimed in claim 1, wherein the means of fixing the eccentric circumferential position of the control passage (144) comprise a centering pin (124; 236), which is guided on the one hand in a blind hole (126) in the control member (70; 230) and on the other in a bore (122; 226) in an intermediate plate (12), of a cylindrical element (13) or a spacing sleeve (202), the face (11) being formed on the intermediate plate (12), on the cylindrical element (13) or on the spacing sleeve (202) .

3. The fuel injection valve as claimed in claim 1, wherein the means of fixing the eccentric circumferential position of the control passage (144) are formed on the circumference of the control member (70; 230) either by shaping of the control member (70; 230) or by a radially arranged pin.

4. The fuel injection valve as claimed in claim 1, wherein the control passage (114) is provided with a restrictor (116).

5. The fuel injection valve as claimed in claim 2, wherein the intermediate plate (12), the cylindrical element (13) or the spacing sleeve (202) have a laterally made bore (48; 22'; 218) in order to connect a longitudinal bore (22; 216) in the housing body (10; 124) to the high-pressure chamber (52; 152; 220) for the delivery of fuel at high pressure.

6. The fuel injection valve as claimed in claim 1, wherein the actuator assembly (26) is fitted into an actuator seating recess (78) open towards an end face (18) of the housing body (10).

7. The fuel injection valve as claimed in claim 2 wherein the actuator assembly (26) is fitted into an actuator seating recess (78') in the cylindrical element (13).

8. The fuel injection valve as claimed in claim 1, wherein the actuator assembly (26) is an electromagnetic actuator (80), having a pilot valve member (82), an actuator spring (94), an operating stem (86) and a stop (98; 99) for limiting the lift (H) of the pilot valve member (82).

9. The fuel injection valve as claimed in claim 8, wherein the operating stem (86) projects into the intermediate plate (12) and the intermediate plate (12) forms a stop (98) for limiting the lift (H) of the operating stem (86) together with the operating stem (86).

10. The fuel injection valve as claimed in claim 8, wherein the stop (99) is a separate piece and is embodied as a plane stop disk (97).

11. The fuel injection valve as claimed in claim 1, wherein the housing body (10; 214) has an accumulator chamber (34), which is arranged on the housing axis (8) and which is hydraulically connected to a bore (22; 216) and to a high-pressure fuel inlet (20) which may be embodied as a high-pressure feed bore (20), the housing body (10; 214) comprising one single piece from its upper end (24) to the end face (18).

12. The fuel injection valve as claimed in claim 11, wherein the high-pressure connection of the high-pressure fuel inlet (20) is situated at a point on the housing body (10) between the accumulator chamber (34) and the actuator assembly (26).

13. The fuel injection valve as claimed in claim 11, wherein the high-pressure fuel inlet (20) enters the housing body (10) laterally at the circumference of the housing body (10) and above the actuator assembly (26), is connected by means of a high-pressure bore (32) to the accumulator chamber (34) of the housing body (10), and is further connected to a longitudinal bore (22), which is situated in the housing body (10) to the side of the actuator assembly (26) and which hydraulically connects the high-pressure feed bore (20) and the accumulator chamber (34) to the high-pressure chamber (52; 152).

14. The fuel injection valve as claimed in claim 1, wherein a nozzle body (132) with a tapered face (134) together with a nozzle body holder (130) seals off the high-pressure chamber (152) to the side of injection bores (54') in the nozzle head (132) and that the nozzle body (132) has a cylindrical collar (136) integrally formed on in one piece, which is supported by a face (**136*a*) on a shoulder (128) of the nozzle body holder (130**).

15. The fuel injection valve as claimed in claim 14, wherein the injection valve member (138) at a short distance from the injection valve seat (54) has a guide (140) together with a guide bore (**152*a*) of the nozzle body holder (130) or the nozzle body (132) and at least one passage (142) in the area of the guide (140), in order to radially guide the injection valve member (138) and to ensure a suitably dimensioned passage (142) from one side of the guide (140**) to the other.

16. The fuel injection valve as claimed in claim 2, wherein a closing part (96; 234) on the actuator axis (8'), which is capable of opening and closing the control passage (114), is radially guided in a bore (224) in the spacing sleeve (202).

17. The fuel injection valve as claimed in claim 1, wherein the injection valve member (30), the closing spring (60), the guide sleeve (58) and the control member (70) are arranged in the nozzle body (14), the actuator assembly (26) is arranged in a cylindrical element (13), an accumulator chamber (34) is formed on the housing body (10), and the nozzle body (14) is fixed to the housing body (10) by means of a clamping nut (16), which encloses the cylindrical element (13).

18. The fuel injection valve as claimed in claim 17, wherein the actuator assembly (26) comprises an actuator spring (94), which engages in a recess in the housing body (10).

* * * * *